US009136069B2

(12) United States Patent
Cho

(10) Patent No.: US 9,136,069 B2
(45) Date of Patent: Sep. 15, 2015

(54) MOVER ASSEMBLY OF CIRCUIT BREAKER

(71) Applicant: LSIS CO., LTD., Anyang-si, Gyeonggi-do (KR)

(72) Inventor: Seong Yeol Cho, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 11 days.

(21) Appl. No.: 13/931,383

(22) Filed: Jun. 28, 2013

(65) Prior Publication Data

US 2014/0009250 A1 Jan. 9, 2014

(30) Foreign Application Priority Data

Jul. 9, 2012 (KR) ..... 10-2012-0074704

(51) Int. Cl.

| | |
|---|---|
| ***H01H 1/00*** | (2006.01) |
| ***H01H 3/38*** | (2006.01) |
| ***H01H 1/22*** | (2006.01) |
| ***H01H 1/58*** | (2006.01) |

(52) U.S. Cl.

CPC ..... *H01H 3/38* (2013.01); *H01H 1/226* (2013.01); *H01H 1/5833* (2013.01)

(58) Field of Classification Search

CPC ..... H01H 71/08; H01H 77/102

USPC ..... 335/6, 15, 16, 8, 12, 46, 73, 106, 335/190–196

See application file for complete search history.

(56) References Cited

U.S. PATENT DOCUMENTS

| | | | | |
|---|---|---|---|---|
| 3,581,253 | A * | 5/1971 | Beaudoin et al. | 335/16 |
| 4,549,153 | A * | 10/1985 | Forsell et al. | 335/16 |
| 5,517,164 | A * | 5/1996 | Zoller et al. | 335/16 |
| 5,793,270 | A * | 8/1998 | Beck et al. | 335/16 |
| 6,015,957 | A | 1/2000 | Papallo, Jr. et al. | |
| 6,570,116 | B2 * | 5/2003 | Maulandi et al. | 218/22 |
| 6,977,568 | B1 * | 12/2005 | Rakus et al. | 335/16 |
| 7,351,927 | B1 * | 4/2008 | Rakus et al. | 200/244 |
| 7,474,179 | B2 * | 1/2009 | Weister et al. | 335/15 |
| 7,518,074 | B2 * | 4/2009 | Weister et al. | 200/244 |
| 7,569,784 | B2 * | 8/2009 | Rakus et al. | 200/244 |

(Continued)

FOREIGN PATENT DOCUMENTS

| | | |
|---|---|---|
| CN | 101901726 | 12/2010 |
| CN | 10219942 | 7/2011 |

(Continued)

OTHER PUBLICATIONS

European Patent Office Application Serial No. 13174616.6, Search Report dated Jan. 7, 2014, 8 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

A mover assembly of a circuit breaker is provided. A mover assembly of a circuit breaker according to one aspect includes: a terminal fixed within a circuit breaker; a connector coupled to the terminal; a plurality of movers rotatably installed in the connector; and an elastic member applying elastic force to the movers to tightly attach the movers to the connector, wherein each of the movers includes a first mover and a second mover and the elastic member is positioned between the first mover and the second mover.

3 Claims, 4 Drawing Sheets

(56) References Cited

U.S. PATENT DOCUMENTS

| | | | | |
|---|---|---|---|---|
| 7,646,269 | B2 * | 1/2010 | Weister et al. | 335/16 |
| 7,683,276 | B2 * | 3/2010 | Weister et al. | 200/244 |
| 8,008,587 | B2 * | 8/2011 | Kapples et al. | 200/244 |
| 8,159,319 | B2 * | 4/2012 | Ferree | 335/16 |
| 8,264,306 | B2 * | 9/2012 | Baek | 335/15 |
| 2008/0088394 | A1 * | 4/2008 | Weister et al. | 335/15 |
| 2008/0218296 | A1 * | 9/2008 | Weister et al. | 335/12 |
| 2010/0258415 | A1 * | 10/2010 | Kapples et al. | 200/244 |
| 2011/0193660 | A1 * | 8/2011 | Baek | 335/15 |

FOREIGN PATENT DOCUMENTS

| | | |
|---|---|---|
| EP | 1873806 | 1/2008 |
| EP | 2348519 | 7/2011 |

OTHER PUBLICATIONS

The State Intellectual Property Office of the People's Republic of China Application Serial. No. 201310286814.1, Office Action dated Jan. 23, 2015, 8 pages.

* cited by examiner

MOVER ASSEMBLY OF CIRCUIT BREAKER

CROSS-REFERENCE TO RELATED APPLICATION

Pursuant to 35 U.S.C. §119(a), this application claims the benefit of earlier filing date and right of priority to Korean Application No. 10-2012-0074704, filed on Jul. 9, 2012, the contents of which is incorporated by reference herein in its entirety.

BACKGROUND OF THE INVENTION

1. Field of the Invention

The present disclosure relates to a mover assembly of a circuit breaker.

2. Background of the Invention

In general, a circuit breaker refers to a device for opening and closing a load device or interrupting a current in the event of an accident such as earthing, short-circuit, or the like, in a transmission & sub-station system or an electrical circuit. Also, a circuit breaker, in which a circuit breaking part is insulated by an insulator and assembled, may generally manually open or close a line in use or may open or close it from a remote area through an electrical manipulator, or the like, outside a metal container. Also, in the event of overload or short-circuit, the circuit breaker automatically cuts off the line to protect an electric power system and a load device.

The circuit breaker includes a terminal unit connecting a power source to a load, a trip unit sensing an overcurrent, a short-circuit current, and the like, generated in the power source and cutting off power supply to an operating unit, the operating unit opening and closing a stator and a mover, and an arc extinguishing unit extinguishing an arc when a fault current and a short-circuit current are generated.

Usually, the stator and the mover are in contact to allow a current to flow therethrough, and when an overcurrent, a short-circuit current, or the like, is generated, the operating unit separates the mover from the stator to interrupt a current.

Meanwhile, the operating unit includes a plurality of movers that make a rotational motion around a rotational shaft (by being centered thereon) to allow a current to flow or interrupt it. Also, the circuit breaker includes a terminal fixedly coupled therein, and the terminal includes a connector having spaces accommodating each of the movers.

The movers are inserted in the accommodation spaces of the connector and in contact with each other, and an elastic member is inserted between the movers and the connector. Upon receiving force applied from the elastic member, the movers and the connector are electrically connected.

In the related art circuit breaker, the movers and the connector are alternately positioned, and a leaf spring is provided between one surface of each mover and the connector. Namely, each mover, upon receiving bearing power from the leaf spring coupled to one side thereof, is coupled to the connector. Here, the other side of each mover is in direct contact with the connector so as to be electrically connected. Thus, when the mover and the stator is connected, majority of a current flowing from the stator to the mover flows to the terminal through the surface in which the mover and the connector are in direct contact.

However, in the related art circuit breaker, since only one side of the mover is in contact with the connector, contact resistance is generated due to imbalance of contact force, which generates heat to increase a temperature within the circuit breaker.

SUMMARY OF THE INVENTION

Therefore, an aspect of the detailed description is to provide a mover assembly capable of minimizing contact resistance due to imbalance of contact force between a mover and a connector and resolving a heating phenomenon due to contact resistance.

To achieve these and other advantages and in accordance with the purpose of this specification, as embodied and broadly described herein, a mover assembly of a circuit breaker according to one aspect includes: a terminal fixed within a circuit breaker; a connector coupled to the terminal; a plurality of movers rotatably installed in the connector; and an elastic member applying elastic force to the movers to tightly attach the movers to the connector, wherein each of the movers includes a first mover and a second mover and the elastic member is positioned between the first mover and the second mover.

The elastic member may provide elastic force to the first mover and the second mover to thrust them outwardly.

The connector may include accommodation portions accommodating the first mover, the elastic member, and the second mover, and the elastic member may provide elastic force to the first mover and the second mover to tightly attach the first mover and the second mover to the sides of the connector adjacent thereto.

A width of the accommodation portion may be equal to or smaller than the sum of a width of the first mover, a width of the second mover, and a width of the elastic member.

To achieve these and other advantages and in accordance with the purpose of this specification, as embodied and broadly described herein, a mover assembly of a circuit breaker according to another aspect includes: a terminal including a connector having a plurality of accommodation portions; a first mover having one end accommodated in the accommodation portion; a second mover having one end accommodated in the accommodation portion, and formed to correspond to the first mover so as to be moved together with the first mover; an elastic member interposed between the first mover and the second mover; and a movable contactor installed in the other ends of the first mover and the second mover, wherein the elastic member tightly attaches the first mover to one side of the accommodation portion and the second mover to the other side of the accommodation portion to allow a current introduced through the movable contactor to flow to the terminal through the first mover and one side of the accommodation portion and through the second mover and the other side of the accommodation portion.

The connector may be integrally formed in the terminal.

The elastic member may provide elastic force thrusting the first mover and the second mover outwardly.

A width of the accommodation portion may be equal to or smaller than the sum of a width of the first mover, a width of the second mover, and a width of the elastic member.

According to an embodiment of the present invention, since both sides of the movers are in contact with both sides of the accommodation portions of the connector and a current flow therethrough, balancing contact force, and thus, contact resistance can be minimized and a rapid increase in a temperature within the circuit breaker can be prevented.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a mover assembly of a circuit breaker according to an embodiment of the present invention will be described in detail with reference to the accompanying drawings. In the following description, usage of suffixes such as 'module', 'part' or 'unit' used for referring to elements is given merely to facilitate explanation of the present invention, without having any significant meaning by itself.

Figure 1:
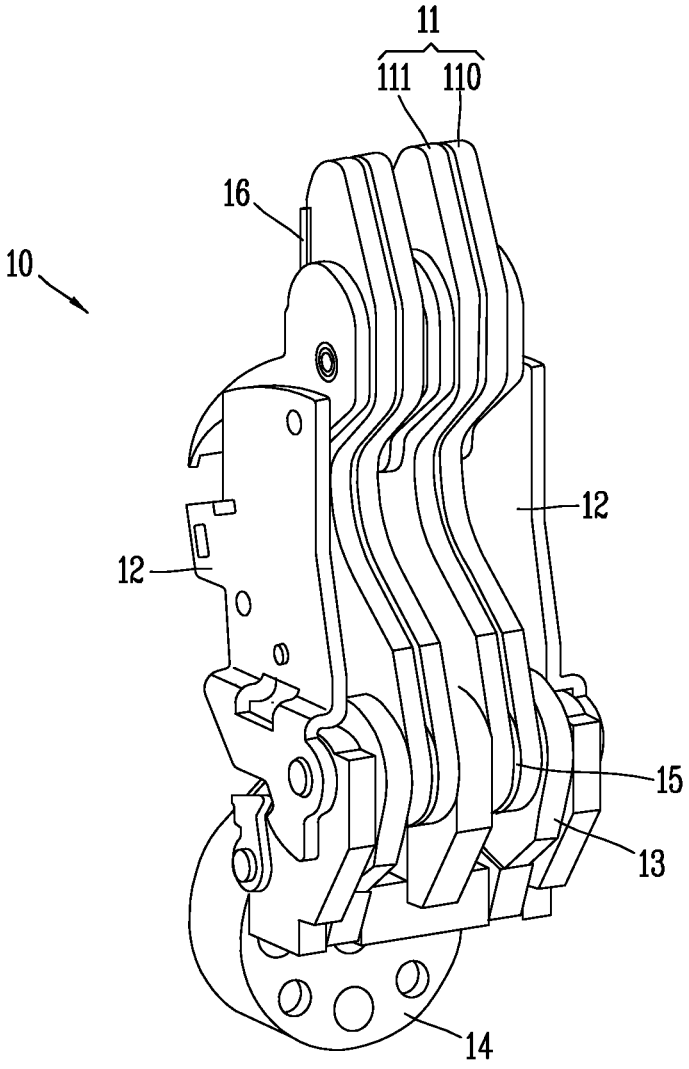
FIG. 1 is a view illustrating a mover assembly according to an embodiment of the present invention.

FIG. 1 is a view illustrating a mover assembly according to an embodiment of the present invention.

Referring to FIG. 1, a mover assembly 10 of a circuit breaker according to an embodiment of the present invention includes a mover 11, a holder 12, a connector 13, and a terminal 14. The terminal 14 is fixed within the circuit breaker (not shown), and the mover 11 may be rotatably coupled to the terminal 14.

The connector 13 having a space allow the mover 11 to be inserted therein may be provided in the terminal 14. The terminal 14 and the connector 13 may be integrally formed. Here, the terminal 14 and the connector 13 may be referred to as a terminal unit.

The holders 12 are provided in both sides of the mover 11, and assembled to the connector 13 through a pin to adjust a position of the mover 11.

A rotational shaft 17 may be inserted to penetrate through the mover 11 such that it is rotatable in a state of being maintained to be in contact with the connector 13 provided in the terminal 14.

In a normal state, a movable contactor 16 of the mover 11 and a fixed contactor of a stator (not shown) connected to the terminal unit supplying power are in contact. A current supplied from the terminal unit at a power source side may flow to the terminal 14 from the stator through the mover 11 and the connector 13.

When an overcurrent or a fault current is generated, the mover 11 is rotated about the rotational shaft 17 (by being centered thereon), and thus, the movable contactor and the fixed contactor may be separated. Thus, the current flowing from the terminal unit at the power source side to the terminal 14 may be interrupted.

As the structure in which the mover 11 is maintained to be in contact with the connector 13 and the structure in which the mover 11 is rotated in the event of an overcurrent or a fault current generation, and the like, the structure of the related art mover assembly 10 may be applied, so a detailed description thereof will be omitted.

Figure 2:
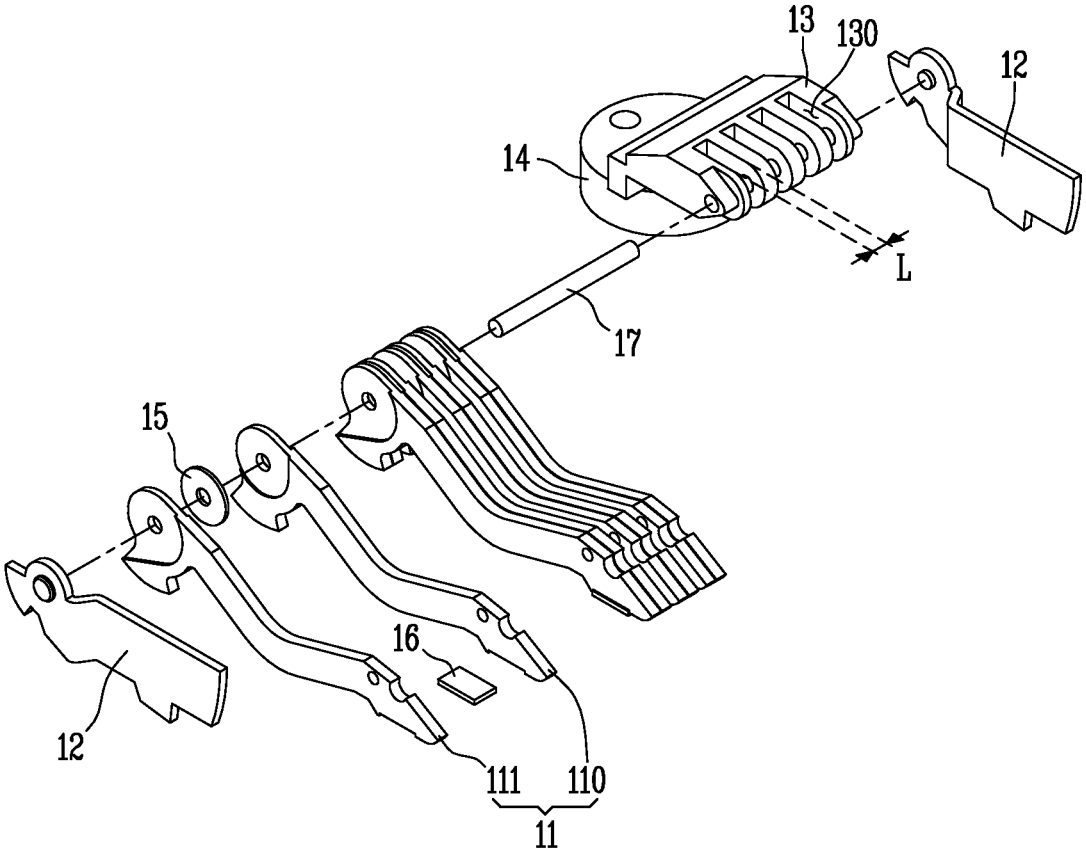
FIG. 2 is an exploded perspective view of the mover assembly of FIG. 1.
Figure 3:
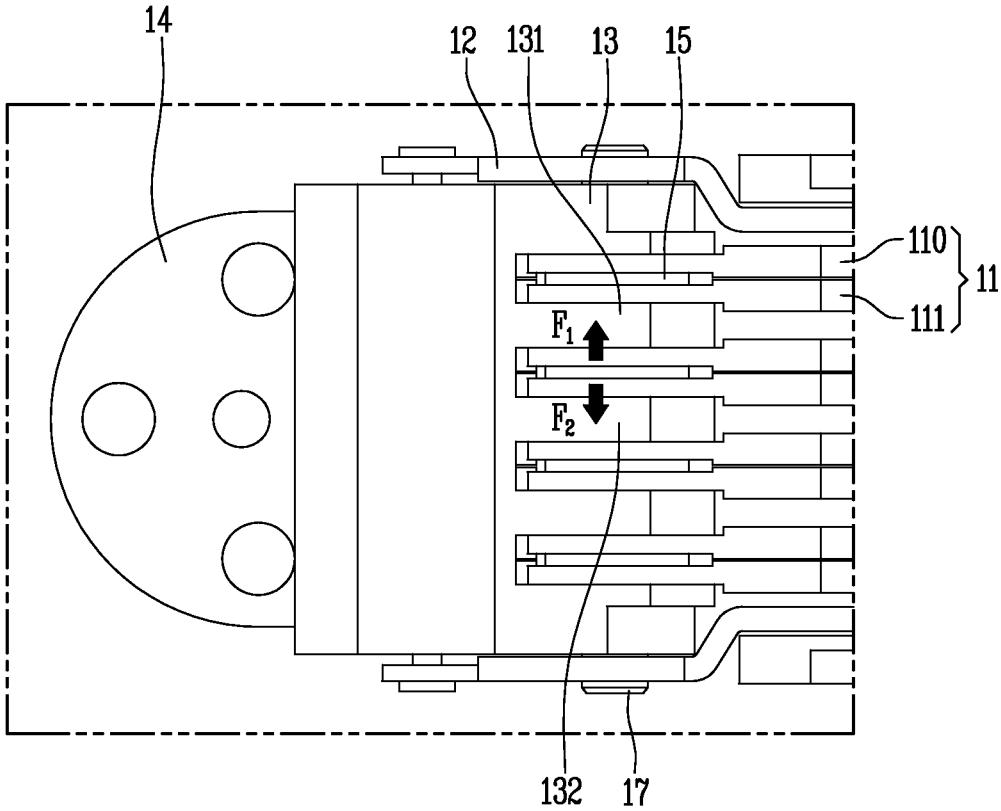
FIG. 3 is a partially enlarged view of the mover assembly according to an embodiment of the present invention.

FIG. 2 is an exploded perspective view of the mover assembly of FIG. 1, and FIG. 3 is a partially enlarged view of the mover assembly according to an embodiment of the present invention.

Referring to FIGS. 2 and 3, the mover assembly 10 according to an embodiment of the present invention includes the mover 11, the connector 13, the terminal 14, an elastic member 15, a movable contactor 16, and a rotational shaft 17. The mover 11, the connector 13, and the elastic member 15 have a hole through which the rotational shaft 17 may be inserted, respectively.

The mover 11 includes a first mover 110 and a second mover 111. The elastic member 15 is disposed between the first mover 110 and the second mover 111. Holes are formed on one sides of the first mover 110 and the second mover 111 through which the rotational shaft 17 may be inserted. The movable contactor 16 may be installed in the other end portions of the first mover 110 and the second mover 111.

The first mover 110 and the second mover 111 may perform rotational motion together. Namely, in a normal state, the first mover 110 and the second mover 111 allow the movable contactor 16 to be maintained in a state of being in contact with a fixed contactor (not shown). In the event of an overcurrent or a fault current, the first mover 110 and the second mover 111 are rotated together around the rotational shaft 17 (by being centered thereon), and thus, the movable contactor 16 is separated from the fixed contactor (not shown).

A plurality of movers 11 may be provided. Namely, a plurality of first movers 110 and a plurality of second movers 111 may be provided.

The connector 13 may include an accommodation portion 130 accommodating portions of the movers 11 and the elastic member 15. A plurality of accommodation portions 130 may be provided to correspond to the movers 11. The connector 13 may have a hole allowing the rotational shaft 17 to be inserted therethrough. A width L of the accommodation portion 130 may be equal to or slightly smaller than the sum of the widths of the first mover 110 and the second mover 111 and a width of the elastic member 15 inserted into the accommodation portion 130. The first mover 110, the elastic member 15, and the second mover 111 are accommodated in the same accommodation portion 130.

The rotational shaft 17 is inserted into the holes formed in the first and second movers 110 and 111, the elastic member 15, and the connector 13. Here, the elastic member 15 is interposed between the first mover 110 and the second mover 111. The elastic member 15 may be a leaf spring or a coil spring. In the case in which the elastic member 15 is a leaf spring, a central portion of the leaf spring may be formed to be bent convexly to both sides. The elastic member 15 between the first mover 110 and the second mover 111 provides elastic force thrusting the first mover 110 and the second mover 111 outwardly.

The elastic member 15 provides force thrusting the first mover 110 and the second mover 111 toward the connector 13 such that the first mover 110 and the second mover 111 are tightly attached to the connector 13. When a portion of the connector 13 with which the first mover 110 is in contact is a first connector 131 and a portion of the connector 13 with which the second mover 111 is in contact is a second connector 132, the elastic member 15 applies force to the first mover 110 in a direction of F1, and applies force to the second mover 111 in a direction of F2. Accordingly, the first mover 110 is tightly attached to the first connector 131, and the second mover 111 may be tightly attached to the second connector 132. Namely, the first mover 110 is tightly attached to one side of the accommodation portion 130, and the second mover 111 is tightly attached to the other side of the accommodation portion 130.

In this manner, the plurality of movers 11 may be accommodated in the accommodation portion 130 and tightly attached to both sides of the accommodation portion 130 in which the respective movers 11 are accommodated. Thus, a contact area between the movers 11 and the connector 13 can be maximized and contact force can be balanced.

Figure 4:
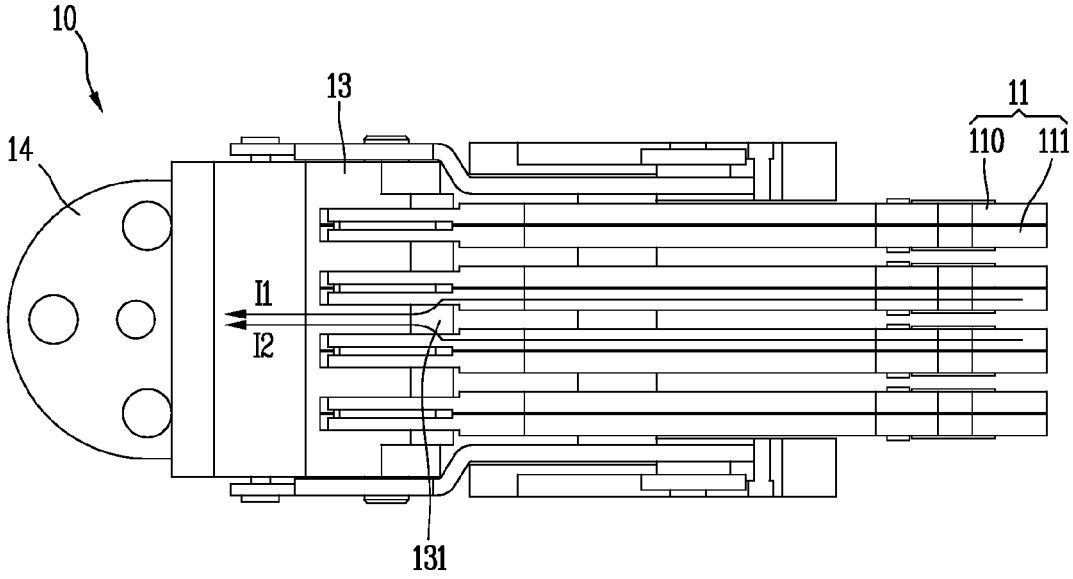
FIG. 4 is a view illustrating the mover assembly according to an embodiment of the present invention.

FIG. 4 is a view illustrating the mover assembly according to an embodiment of the present invention.

Referring to FIG. 4, a current may flow through both sides of the first connector 131. The elastic member 15 is interposed between the first mover 110 and the second mover 111 to tightly attach the first mover 110 and the second mover 111 to the sides of the adjacent first connector 131 and the second connector 132, thus securing a wide contact area between the movers 11 and the connector 13.

When the movable contactor 16 and the fixed contact (not shown) are brought into contact, a current flows from a terminal unit of the fixed contactor (not shown), and the current flows to the movers 11 through the movable contactor 16. The current flowing through the movers 11 flows to the connector 13 through the contact surface between the first connector 131 and the second connector 132. the current, passing through the connector 13, may flow to a device connected to the terminal 14. Namely, the current may flow to the device connected to the terminal 14 through the one sides of the first mover 110 and the accommodation portion 130 and the other sides of the second mover 111 and the accommodation portion 130.

The movers 11 are in contact with both sides of the first connector 131, and the first connector 131 receives currents I1 and I2 through the movers 11 in contact with both sides thereof.

In this manner, the contact area between the connector 13 and the movers 11 is increased and contact force between the connector 13 and the movers 11 is balanced, minimizing contact resistance, and heat generated by contact resistance is reduced to effectively lower internal temperature of the circuit breaker.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A mover assembly of a circuit breaker, the mover assembly comprising:

a terminal fixed within the circuit breaker;

a connector coupled to the terminal and having a plurality of accommodation portions;

at least one mover rotatably installed in each of the plurality of accommodation portions, each of the at least one mover including a first mover and a second mover;

a movable contactor installed at one end portion of the first mover and second mover of each of the at least one mover such that the corresponding first mover and second mover rotate together; and an elastic member positioned between the first mover and the second mover of each of the at least one mover, wherein the first mover of each of the at least one mover is formed symmetrically with the corresponding second mover and has a side portion fully adhered to the corresponding second mover, wherein the elastic member provides elastic force to the corresponding first mover and second mover to tightly attach the first mover and second mover to adjacent sides of the corresponding accommodation portion.

2. The mover assembly of claim 1, wherein the elastic force thrusts the corresponding first mover and second mover outward.

3. The mover assembly of claim 1, wherein a width of each of the plurality of accommodation portions is equal to or smaller than a sum of a width of the corresponding first mover, a width of the corresponding second mover, and a width of the corresponding elastic member.

* * * * *